United States Patent [19]

Beneze

[11] Patent Number: 4,630,422

[45] **Date of Patent: * Dec. 23, 1986**

[54] PENETRATING ROOFING MECHANICAL FASTENING SEALING SYSTEM AND METHOD

[75] Inventor: Heinz W. Beneze, Richfield, Ohio

[73] Assignee: The Firestone Tire & Rubber Company, Akron, Ohio

[ * ] Notice: The portion of the term of this patent subsequent to Nov. 4, 2003 has been disclaimed.

[21] Appl. No.: 693,550

[22] Filed: Jan. 22, 1985

[51] Int. Cl.[4] ..... E04B 5/00; E04B 1/38

[52] U.S. Cl. ..... 52/410; 52/512; 52/741; 411/369

[58] Field of Search ..... 52/410, 469, 417, 521, 52/466, 467, 469, 408, 222, 741, 512; 24/459, 525; 411/368, 369, 531, 542

[56] References Cited

U.S. PATENT DOCUMENTS

| | | | |
|---|---|---|---|
| 1,084,339 | 1/1914 | Holzberg | 24/459 |
| 3,494,246 | 2/1970 | Hensley | 24/95 |
| 3,745,613 | 7/1973 | Daddona | 411/501 |
| 4,074,501 | 2/1978 | Sandqvist | 52/741 |
| 4,393,558 | 7/1983 | Herwegh et al. | 24/459 |
| 4,445,306 | 5/1984 | Schauffele | 52/410 |
| 4,455,804 | 6/1984 | Francovitch | 52/698 |
| 4,467,581 | 8/1984 | Francovitch | 52/410 |
| 4,471,548 | 9/1984 | Goudie | 52/646 |
| 4,519,175 | 5/1985 | Resan | 52/410 |
| 4,520,606 | 6/1985 | Francovitch | 52/410 |

FOREIGN PATENT DOCUMENTS

| | | |
|---|---|---|
| 737640 | 7/1966 | Canada . |
| 2433669 | 7/1974 | Fed. Rep. of Germany . |

*Primary Examiner*—Carl D. Friedman
*Assistant Examiner*—John M. White
*Attorney, Agent, or Firm*—Ernst H. Ruf

[57] ABSTRACT

A penetrating mechanical roofing fastening and sealing system for securing a flexible sheet, provided with a plurality of apertures, to the upper surface of a roof via the use of a plurality of spaced penetrating fastening and sealing devices, each of which includes upper and lower retainers, wherein the latter are anchored to the roofing surface and the elastomeric sheet is thereafter spread thereover, with cutting portions on the lower retainers being utilized to produce the sheet apertures, rigid upper retainers overlie and completely cover the apertures and the retainers are clamped together in a sealing relationship with the interposed sheet portion. A method for securing and sealing a flexible sheet to the roofing substrate is also presented.

19 Claims, 2 Drawing Figures

PENETRATING ROOFING MECHANICAL FASTENING SEALING SYSTEM AND METHOD

TECHNICAL FIELD

The field of art to which this invention pertains is that of roofing mechanical fastening systems, particularly to a fastening and sealing device for mechanically securing a flexible sheet, having an aperture, to a roofing substrate in a continuous sealing relationship with the device.

BACKGROUND OF THE ART

A large number of commercial and factory or plant roofs are of a flat roof design wherein the roofing material itself is often of a built-up asphalt and, in more modern systems, of a single ply EPDM elastomeric sheet or membrane. In terms of securing a single ply EPDM membrane to the roof itself, one design utilizes a mechanical ballast system that uses a layer of stone over the membrane. While the ballast system is least expensive, it has the disadvantage of being quite heavy (approximately 10 pounds per sq. foot) thus requiring a heavy roof support structure and, in addition, the roof slope cannot exceed 10°.

Adhered roof membrane retention systems suffer from a cost penalty while mechanical fastening systems generally require a fixation to the roofing substrate via mechanical fasteners. There are two basic kinds of such mechanical fasteners, namely membrane penetrating and non-penetrating ones. Each of these types of fasteners has a number of favorable features and each of them is also subject to various drawbacks and disadvantages.

An example of a non-penetrating type fastener is shown in German Patent publication No. 2,433,669 to Ott, which discloses a membrane fastener comprising a lower disc attached to a roofing substrate by anchoring member. The roofing membrane is fitted over the lower disc and an upper disc is snapped over the lower disc to perfect the fastening and exert a sealing effect. A plug is then driven into the upper disc to expand the body thereof into an annular space provided in the lower disc to anchor the upper disc to the lower disc. Non-penetrating fastener or anchoring systems have the disadvantage of introducing wrinkles into the elastomeric membrane. Wrinkles are indicative of tension and tension, in rubber, is known to cause undesirable cracks.

Mechanical fastening systems, of the penetrating type, generally require fixation to the roofing substrate by a metal fastener with metal or rubberized nailing strips. U.S. Pat. No. 4,445,306 to Schauffele sets forth a mechanically attached roofing system wherein an elongated fastening bar is placed above the membrane and fastened to the roofing structure with fasteners such as screws or nails which are driven through the bar from the top thereof through the underlying membrane into the roofing structure. An elongated waterproof strip, sandwiched beneath the bottom of the bar and the membrane, and through which the fasteners pass, has its marginal sections wrapped upwardly around the bar to overlap each other above the bar and the head of each fastener.

U.S. Pat. No. 4,074,501 to Sandqvist discloses a method and apparatus for securing a sealing layer on a flat roof by means of a number of plates and screws passing through those plates. A membrane layer is attached to a roofing substrate by means of a plate composed of a semi-rigid material in which is formed a centrally located aperture into which is inserted a self-cutting screw that anchors the assembly to the roofing substrate. A bonding agent is required at the screw and the plate edges.

U.S. Pat. Nos. 4,455,804 and 4,467,581 to Francovitch both pertain to membrane anchors wherein the former utilizes a disc of rubber-like material having a central opening and downwardly inclined upper and lower surfaces, the lower surface having grooves for receiving mastic. A linear fastener extends through a central opening. The latter pertains to a resilient metal anchoring system composed of resilient metal that secures a roofing membrane to a substrate wherein the disc-like anchor, having downwardly facing cavities, is anchored to the substrate by a fastener. Grooves below the central region serve to seal the membrane around a perforation formed by the fastener and flexure zones on the outer periphery of the anchor further serve to seal the membrane.

DISCLOSURE OF THE INVENTION

The present invention provides a solution to the deficiencies of the previously-discussed prior art penetrating fastener constructions by permitting attachment of a flexible waterproof membrane to an underlying roof structure by mechanical means that consist of two circular disks that are pressed against each other by clamping means wherein the disks utilize the membrane itself as a seal therebetween. One of the disks includes means for cutting so as to produce an aperture in the membrane. No adhesive or any other sealing is required. In addition, clamping force and anchoring force are two separate entities since the means for anchoring the lower disk or retainer to the roofing structure is totally separate from the means for clamping the disks or retainers together.

In the penetrating, fastening and sealing device of the present invention, a flexible elastomer sheet is mechanically secured to the upper surface of a roof, wherein a plurality of rigid lower retainers are first anchored to the roof at a plurality of desired locations, each of the lower retainers including, on its upper surface, means for cutting the membrane. After spreading the flexible elastomeric membrane over the roof upper surface, including the anchored lower retainers, apertures are provided at each such location, utilizing the means for cutting to produce these apertures. Rigid upper retainers, each having an area greater than the sheet aperture area, are adapted to overlie and completely cover each of the apertures, thereby confining a continuous peripheral portion of the sheet, ordering the sheet apertures between the upper and lower retainers. Clamping means are utilized for pressing together the upper and lower retainers into a continuous sealing relationship with the sheet or membrane.

The means for cutting preferably takes a form of a sharp annular edge that is located on a stepped center portion of the lower retainer upper surface. This stepped center portion also has an outer peripheral surface that is adapted for locating the corresponding peripheral wall portion of the adjacent sheet portion that defines the aperture.

The lower retainer upper surface preferably also includes a continuous outer flange portion that is adapted to underlie a corresponding portion of the lower surface of the sheet. The upper retainer also has a stepped center portion whose area and shape generally correspond with those of the lower retainer center portion for mating engagement therewith.

The method for mechanically securing and sealing the flexible and elastomeric sheet to the upper surface of the roof, via the use of a plurality of spaced, penetrating, fastening and sealing devices includes the steps of determining desired locations for the devices on the roof upper surface; physically anchoring, at each location, a lower retainer to the roof upper surface, each of the lower retainers including, on its upper surface, means for cutting; spreading the flexible elastomeric sheet over the upper roof surface, including the anchored lower retainers; providing, at each location, an aperture through the sheet utilizing the cutting means on the lower retainer upper surface; placing, at each location, the upper retainer, which is larger than the aperture, over the aperture and completely covering the aperture so as to confine a continuous peripheral portion of the sheet, adjacent to the sheet aperture, therebetween; and pressing the upper and lower retainers together so as to achieve a continuous sealing relationship with the sheet.

Other features and the advantages of the present invention will become more readily understood by persons skilled in the art when following the best mode description in conjunction with the several drawings.

BEST MODE FOR CARRYING OUT THE INVENTION

Figure 1:
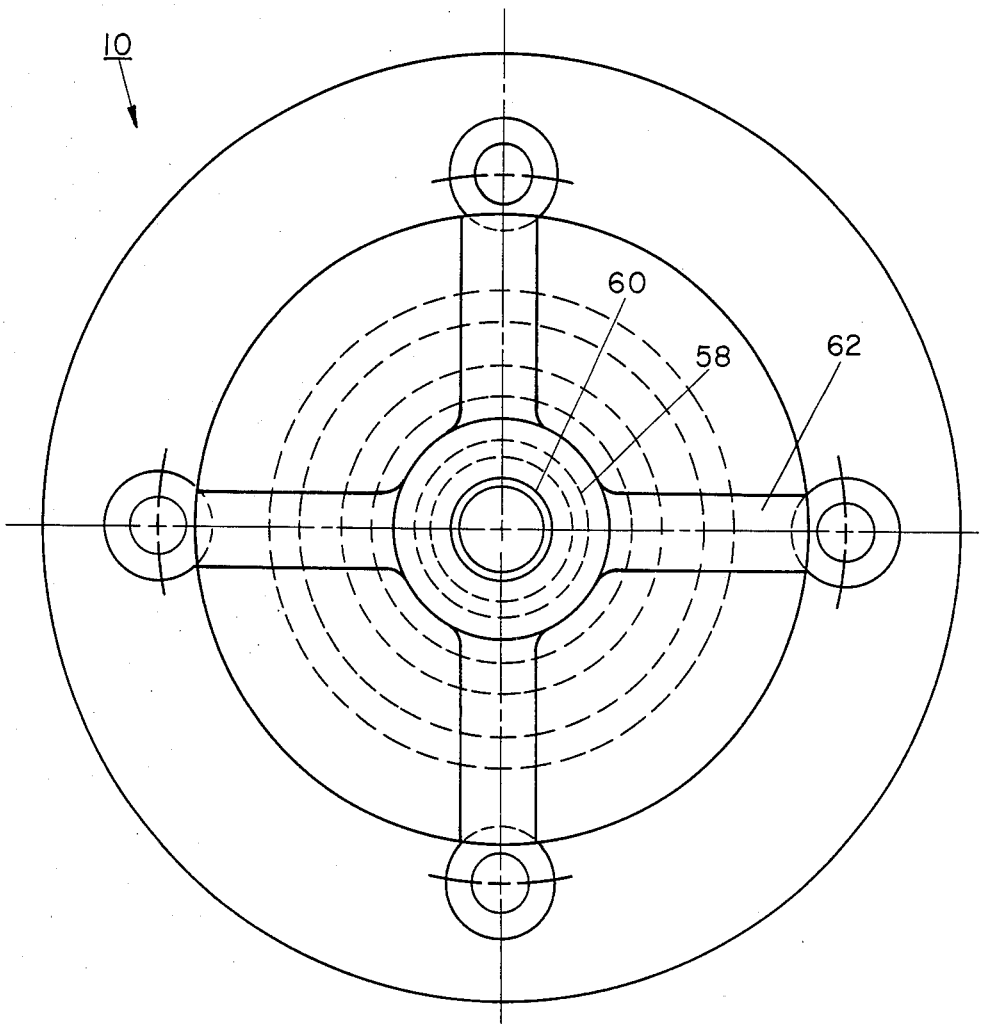
FIG. 1 is a top plan view of the penetrating roofing fastener of the present invention.

Referring now to the drawings, there is illustrated a penetrating roofing fastener 10 which basically includes rigid lower retainer 14, anchoring means 16 therefor, rigid upper retainer 18 and central clamping means 20. Fastener 10 is utilized for securing an annular or ring-shaped portion 22 of a flexible sheet or membrane 12 between retainers 14 and 18 in a manner to be described hereinafter.

Figure 2:
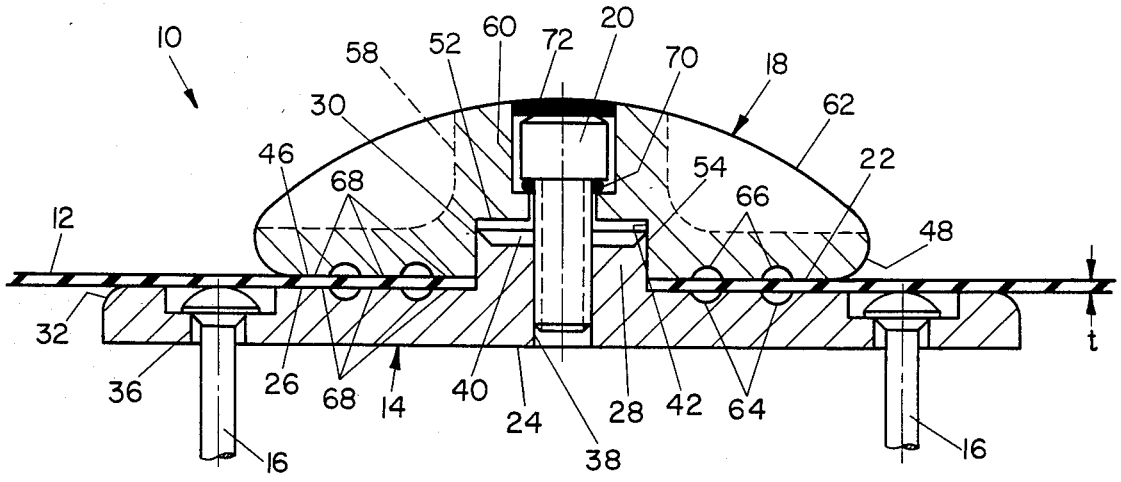
FIG. 2 is a cross sectional view of the penetrating roofing fastener of FIG. 1 together with the interposed roofing membrane, anchoring means and fastening means.

As best seen in FIG. 2, rigid lower retainer 14, is provided with a generally flat bottom surface 24 and a vertically spaced flat annular upper surface 26 whose axially-innermost edge merges into the vertical peripheral outer surface 30 of circular stepped central upper portion 28. The radially outermost edge of 32 of annular surface 26 is beveled or radiused in order to remove any sharp corners.

Lower retainer 14 is also provided with a plurality of preferably equally radially and circumferentially spaced stepped apertures 36, the latter permitting the partial passage therethrough of anchoring means 16, each of which preferably takes the form of a self threading spike, with apertures 36 being such that the head of the spike does not protrude therefrom above the plane containing annular upper surface 26. Stepped central portion 28 also includes a threaded central aperture 38. In addition, the vertically uppermost edge of peripheral surface 30 of portion 28 is provided with an inwardly tapering generally anvil-shaped surface 40 so that the intersecting edge of surfaces 30 and 40 define a sharp annular edge 42 which can be used as a cutting means in a manner to be described hereinafter.

Turning now to rigid upper retainer 18, it includes a generally annular flat bottom surface 46 whose outermost edge 48 is beveled or radiused in order to remove any sharp corners. Upper retainer 18 is also provided with a central stepped or recessed circular central portion 52 having a vertical peripheral outer surface 54, with central portion 52 being of a size and shape to closely matingly engage with lower retainer circular stepped central portion 28 as best seen in FIG. 2.

Upper retainer 18 is also provided with a circular central boss portion 58 which in turn is provided with a stepped central aperture 60 concentric with lower retainer threaded central aperture 38. Furthermore, upper retainer 18 may be provided with a plurality of preferably equally spaced and radially outwardly directed stiffing ribs 62 whose outer ends merge smoothly into edges 48.

In order to further enhance the water tightness of the seal, inherently provided by membrane annular portion 22, between retainers 14 and 18, lower retainer upper surface 26 may be provided with a plurality of concentric annular grooves 64 while upper retainer 14 may be provided with a similar plurality of corresponding but oppositely directed annular grooves 66 in its annular surface 46. The use of opposing grooves 64 and 66 tends to produce in both surfaces 26 and 46, a plurarility of opposing and concentric land areas 68, which act as independent sealing areas relative to annular membrane portion 22.

It should be understood that the diameter of upper retainer 18 could be such that it totally covers lower retainer 14 i.e., that they both have similar diameters. Furthermore, if desired, in terms of avoiding all possibilities of leakage around clamping means 20, which preferably takes the form of a socket head cap screw, it can be provided with a sealing member, such as an O ring 70 and/or a resilient disc member 72 which can be inserted in aperture 60.

It should be evident that the insertion of cap screw 20 into upper retainer 18 and securing the former in lower retainer threaded aperture 38 will sealingly confine membrane annular portion 22 between retainers 14 and 18. Retainers 14 and 18 are preferably made of a rigid light weight and corrosion resistant material such as aluminum or of a high strength plastic material.

Turning now to the method for installing fastener 10, initially, the installer must first predetermine the desired location (and spacing etc.) of each of the fasteners required for achieving the particular roofing job. After marking these locations on the roofing substrate (not shown), the lower retainers are physically anchored to the roofing substrate so that the lower retainer bottom surface 24 is coplanar with said substrate. While generally even a single anchor means, which preferably takes the place of self-threading spike, is sufficient, a plurality of apertures 36 is provided in case spike 16 enters a void in the roofing substrate.

After all required lower retainers are anchored, flexible sheet or membrane 12 is rolled out over the roofing substrate, i.e., therefore covering lower retainers 14. Naturally, the presence of each retainer 14 will be evident due to its stepped central upper portion 28. At each retainer location, an aperture is produced that is equal in diameter to the diameter of stepped portion 28. This aperture is produced by utilizing cutting edge 42 of retainer stepped portion 42 in combination with any desired reaction member, such as for example a mallet or die punch, etc. After removing the severed circular membrane portion, upper retainer 18 is placed over lower retainer 14 so that the stepped central portion of the former mates with the stepped central portion of the latter i.e., that vertical outer peripheral surface 54 of upper retainer 18 is matingly located relative to vertical peripheral outer surface 30 of lower retainer 14. The insertion and subsequent tightening of cap screw 20, of course, presses upper retainer 18 against lower retainer 14 thereby sealingly confining annular membrane portion 22 therebetween in the manner already described.

Membrane 12, specifically its annular portion 22, as confined between opposing land areas 68, acts as a seal, with no further adhesive or other sealing being required. Clamping force and anchoring force are two entities that may differ in magnitude depending on the building site requirements.

It should be understood that the actual fastener dimensions may change depending on the specific installation requirements. The thickness t of membrane 12 will present no problem since the vertical extent of peripheral surface 30 of stepped portion 28 is substantially greater than said noted thickness.

Thus, while membrane thickness is no problem, the uniformity thereof could, however, be a possible problem if the edge of the factory or field splice falls within or passes through membrane annular portion 22. However, the use of generously sized annular grooves 64 and 66 permits a certain amount of deformation of membrane portion 22 and, in addition, the use of the several concentric and independent land areas 68 will permit several circumferential zones or bands of sealing or gasketing so as to minimize the noted possible problem.

The penetrating fastener and installation method of the present invention finds specific utility in mechanically securing elastomeric sheeting in flat or spherical roofing applications. However, from the foregoing description, when read in light of the several drawings, it is believed that those familiar with the art will readily recognize and appreciate the novel concepts and features of the present invention. Obviously, while the invention has been described in relation to only a limited number of embodiments, numerous variations, changes, substitutions and equivalents will present themselves to persons skilled in the art and may be made without necessarily departing from the scope and principles of this invention. As a result, the embodiments described herein are subject to various modifications, changes and the like without departing from the spirit and scope of the invention with the latter being determined solely by reference to the claims appended hereto.

What is claimed is:

1. A penetrating, fastening and sealing device for both mechanically securing a flexible elastomeric sheet, of a range of thicknesses, to the upper surface of a roof, and sealingly engaging said sheet, said device comprising in combination:

(a) a rigid lower retainer including, on its upper surface a sharp annular edge for cutting an aperture of a first predetermined area and shape in the elastomeric sheet, said lower retainer having an area greater than said sheet aperture;

(b) means for anchoring said lower retainer to said roof upper surface;

(c) a rigid upper retainer, having an area greater than said sheet aperture area, adapted to overlie and completely cover said aperture, thereby confining a continuous peripheral portion of said sheet, bordering said sheet aperture, between said upper and lower retainers; and (d) separate fastener means engageable with a center portion of the upper retainer and extending from said upper retainer into a center portion of the lower retainer for drawing said retainers perpendicularly against each other to sealingly secure the elastomeric sheet between said retainers.

2. The penetrating, fastening and sealing device of claim 1 wherein said upper retainer also includes a central boss portion having a stepped central aperture which is adapted to receive said separate fastener means for drawing the retainers perpendicularly against each other.

3. The penetrating, fastening and sealing device of claim 1 wherein said upper retainer is provided with a plurality of radially directed stiffening ribs.

4. The penetrating, fastening and sealing device of claim 1 wherein said sharp annular edge is located on a stepped center portion of said lower retainer upper surface.

5. The penetrating, fastening and sealing device of claim 2 wherein said stepped center portion also has an outer peripheral surface adapted for locating the corresponding peripheral wall portion of the adjacent sheet portion that defines said aperture.

6. The penetrating, fastening and sealing device of claim 2 wherein said lower retainer stepped center portion is provided with a threaded central aperture adapted to cooperate with said separate fastener means for drawing the retainers perpendicularly against each other.

7. The penetrating, fastening and sealing device of claim 2 wherein said lower retainer upper surface includes a continuous outer flange portion adapted to underlie a corresponding portion of a lower surface of said sheet.

8. The penetrating, fastening and sealing device of claim 5 wherein said upper retainer has a lower surface having the center portion which is stepped whose area and shape generally corresponds with those of said lower retainer stepped center portion, for mating engagement therewith.

9. The penetrating, fastening and sealing device of claim 6 wherein said upper retainer lower surface further includes a continuous outer flange portion adapted to overlie a corresponding portion of the upper surface of said sheet.

10. The penetrating, fastening and sealing device of claim 7 wherein said lower retainer outer flange portion is provided with at least two circumferentically spaced apertures adapted for receiving said means for anchoring.

11. The penetrating, fastening and sealing device of claim 9 wherein the radial spacing of said apertures, relative to the center of said lower retainer is greater than the radial extent of said upper retainer.

12. The penetrating, fastening and sealing device of claim 7 wherein said upper retainer lower surface flange portion is of a size and shape so as to overlap, at least a circumferentially continuous portion, of said lower retainer outer flange portion to thereby confirm a continuous portion of said sheet, bordering said aperture, between said upper and lower retainer flange portions.

13. A penetrating, fastening and sealing device for both mechanically securing a flexible elastomeric sheet, of a range of thicknesses, to the upper surface of a roof and sealingly engaging said sheet, said device comprising in combination: a rigid lower retainer; means for anchoring said lower retainer to said roof upper surface; a rigid upper retainer adapted to mate with said lower retainer; and means for clamping said upper and lower retainers together, (a) each of said lower retainers including, on its upper surface, a stepped center portion, having a sharp annular edge for cutting an aperture of a first predetermined area and shape in the elastomeric sheet, and said stepped center portion also having an area and shape substantially corresponding with those of such sheet aperture, said stepped center portion also being utilized as a locating means for said aperture, said upper surface further including a continuous outer flange portion adapted to underlie a corresponding portion of the lower surface of said sheet;

(b) each of said upper retainers including, on its lower surface, a stepped center portion having an area and shape substantially corresponding with those of said lower retainer center portion for mating engagement therewith, said lower surface further including a continuous outer flange portion adapted to overlie a corresponding portion of the upper surface of said sheet, said lower surface flange portion being of a size and shape so as to overlap, at least a circumferentially continuous portion, of said lower retainer outer flange portion and thereby confining a continuous portion of said sheet, bordering said aperture, between said upper and lower retainer flange portion; and (c) said clamping means including separate fastener means engageable with the stepped center portion of the upper retainer and extending from said upper retainer into the stepped center portion of the lower retainer for drawing said retainers perpendicularly against each other to sealingly secure the elastomeric sheet between said retainers.

14. The penetrating, fastening and sealing device of claim 13 wherein the flange portions of said upper and lower retainers are parallel with each other and said lower retainer bottom surface.

15. The penetrating, fastening and sealing device of claim 13 wherein the opposing flange surfaces of said upper and lower retainers are parallel to one another, at least one of said surface, being provided with a plurality of radially spaced circularly extruding concentric annular grooves.

16. A method for mechanically securing and sealing a flexible elastomeric sheet to the upper surface of a roof via the use of a plurality of spaced penetrating fastening and sealing devices, each of which includes upper and lower retainers, means for anchoring said lower retainer to said roof upper surface and means for clamping said upper and lower retainers together, each of said devices being used in conjunction with an aperture formed in said sheet by the lower retainer, said method comprising the steps of:

(a) determining desired locations for said devices on said roof upper surface;

(b) physically anchoring, at each of said locations, a lower retainer to said roof upper surface, each of said lower retainers including, on its upper surface, a sharp edge for cutting an aperture in the elastomeric sheet;

(c) spreading said flexible elastomeric sheet over said roof upper surface and said anchored lowered retainers;

(d) piercing an aperture through said sheet at each location by pressing said sheet into contact with the sharp edge of the lower retainer;

(e) placing, at each location, said upper retainer, which is larger than said aperture, over said aperture to overlie and completely cover said aperture, thereby confining a continuous peripheral portion of said sheet, bordering said aperture, between said upper and lower retainers; and (f) fastening and drawing said upper and lower retainers perpendicularly together with separate fastener means to sealingly secure the elastomeric sheet between said retainers.

17. The method of claim 16, wherein said piercing step includes utilizing a stepped center portion of said lower retainer upper surface which has the sharp edge thereon as a locating means for said aperture.

18. The method of claim 17 wherein said placing step includes matingly engaging said lower retainer stepped center portion with a corresponding center portion of a lower surface of said upper retainer, with a continuous outer flange portion of said lower surface being adapted to overlie at least a continuous portion of said lower retainer outer flange portion, thereby confining a continuous peripheral portion of said sheet therebetween.

19. A method for mechanically securing and sealing a flexible elastomeric sheet to the upper surface of a roof via the use of a plurality of spaced penetrating fastening and sealing devices, each of which includes upper and lower retainers, means for anchoring said lower retainer to said roof upper surface and means for clamping said upper and lower retainers together, each of said devices being used in conjunction with an aperture formed in said sheet by the lower retainer, said method comprising:

(a) determining desired locations for said devices on said roof upper surface;

(b) physically anchoring, at each of said locations, a lower retainer to said upper surface, each of said lower retainers including, on its upper surface, a stepped center portion, having a sharp annular edge, and a continuous outer flange portion;

(c) spreading said flexible elastomeric sheet over said roof upper surface and said anchored lowered retainers;

(d) piercing an aperture through said sheet at each location by pressing said sheet into contact with said sharp annular edge and utilizing said stepped center portion as the locating means for said aperture, said sheet overlying the lower retainer upper surface outer flange portion;

(e) placing, at each location, said upper retainer, which is of a third predetermined size larger than said first predetermined size, over said lower retainer stepped portion so that it matingly engages with a corresponding center portion of said upper retainer lower surface, with a continuous outer flange portion of said lower surface being adapted to overlie a corresponding portion of the upper surface of said sheet, said lower surface flange portion being of the size and shape so as to overlap at least a continuous portion of said lower retainer outer flange portion of said sheet, bordering said aperture, therebetween; and (f) fastening and drawing said upper and lower retainers perpendicularly together with separate fastener means to sealingly secure the elastomeric sheet between said retainers.

* * * * *